US005508797A

United States Patent [19]

Tonai et al.

[11] Patent Number: 5,508,797

[45] Date of Patent: Apr. 16, 1996

[54] COLOR IMAGE FORMING APPARATUS HAVING TONER IMAGE FORMING DEVICE

[75] Inventors: Keiko Tonai; Yoshihiro Tonomoto, both of Kawasaki, Japan

[73] Assignee: Fujitsu Limited, Kawasaki, Japan

[21] Appl. No.: 251,845

[22] Filed: May 31, 1994

[30] Foreign Application Priority Data

Sep. 8, 1993 [JP] Japan ..... 5-247532

[51] Int. Cl.[6] ..... G03G 15/20

[52] U.S. Cl. ..... 355/285

[58] Field of Search ..... 355/285, 286, 355/289, 290, 295

[56] References Cited

U.S. PATENT DOCUMENTS

| | | | |
|---|---|---|---|
| 4,549,803 | 10/1985 | Ohno et al. | 355/285 X |
| 5,177,552 | 1/1993 | Isogai et al. | 355/285 |
| 5,216,225 | 6/1993 | Muto et al. | 355/285 X |
| 5,327,202 | 7/1994 | Nami et al. | 355/285 X |

FOREIGN PATENT DOCUMENTS

| | | |
|---|---|---|
| 54-82244 | 6/1979 | Japan . |
| 58-11977 | 1/1983 | Japan . |
| 60-263173 | 12/1985 | Japan . |
| 61-70571 | 4/1986 | Japan . |

*Primary Examiner*—Fred L. Braun

*Attorney, Agent, or Firm*—Armstrong, Westerman, Hattori, McLeland & Naughton

[57] ABSTRACT

A color image forming apparatus which forms a monochromatic toner image or a toner image in a plurality of colors and which can considerably reduce power consumption, while preventing an offset at the time of fixing a toner image. The color image forming apparatus includes a toner image forming device for forming a monochromatic toner image or a toner image in a plurality of colors on a recording medium; first heating device, located on a toner image side of the recording medium for fixing the toner image on the recording medium by heat; second heating device located on an opposite side to the toner image side of the recording medium; and a controller for making an amount of power supply to the second heating device constant and changing an amount of power supply to the first heating device depending on whether the toner image is monochromatic or is in a plurality of colors, while making a set temperature of the first heating device constant. The controller sets the power supply of the fixing or fusing device as a function of whether the toner image is a monochromatic, plural colors or full colored toner image.

9 Claims, 15 Drawing Sheets

COLOR IMAGE FORMING APPARATUS HAVING TONER IMAGE FORMING DEVICE

BACKGROUND OF THE INVENTION

1. Field of the Invention

The present invention generally relates to a color image forming apparatus which forms a monochromatic toner image or a toner image in a plurality of colors. More particularly, this invention relates to a color image forming apparatus which changes fixing energy depending on whether a toner image is monochromatic or in a plurality of colors.

Due to a demand for image recording on ordinary sheets of paper, image forming apparatuses (such as, a copying machine, a printer and a facsimile) employ a latent-image forming type recording apparatus (e.g., electrophotographing apparatus). Such an image forming apparatus forms an electrostatic latent image on a photosensitive drum and then develops the latent image to form a toner image. After transferring the toner image on the photosensitive drum onto a sheet, the apparatus fixes the toner image on the sheet by heat.

In view of a demand for printing colored images, color image forming apparatuses for forming a toner image in a plurality of colors have been developed and are available. The color image forming apparatuses can form monochromatic toner images, as well as toner images in a plurality of colors, and are thus used to print both types of toner images. As this image forming apparatus uses heat to fix a toner image, most of the power consumed by the apparatus is used for image fixation. Since the fixing process needs fixing energy that is related to the thickness of the layer of toners, greater fixing energy is needed to fix a toner image in a plurality of colors; thus, increasing the amount of power consumption of the apparatus. It is therefore desirable to reduce the amount of power consumption for such a fixing process; and this invention accomplishes such an objective.

2. Description of the Relevant Art

In general, the fixing energy E necessary to fix a toner image essentially includes energy E1 for melting toners, and energy E2 which is absorbed in a sheet. The energy E2, absorbed in a sheet, is the same for the fixing energy E for monochromatic printing and the fixing energy E for color printing. However, the energy E1 required to melt toners depends on the thickness of the toner layer, etc., as apparent from the following equation, and thus, varies in accordance with the thickness of the toner layer:

E1=sheet feeding speed×sheet width ×toner layer thickness×toners' specific heat ×toners' specific weight ×rising temperature of toners/heat efficiency. (1)

Monochromatic printing involves a single toner layer, whereas color printing requires different colors to be placed one on another and thus, involves a plurality of toner layers. For instance, two toner layers are needed for multicolored (seven colors) printing, and four toner layers for full color printing. Therefore, greater energy to melt toners is needed for color printing than for monochromatic printing.

In view of the above, the fixing energy may be set to a constant level that is needed for the fixation of a full-colored image; and this fixing energy is used for the fixation of a monochromatic image. This method, however, results in wasteful power consumption because the energy for fixing a full-colored image is more than four times the energy for monochromatic printing.

In order to overcome these deficiencies, various methods have been proposed to reduce the power consumed by the above type of color image forming apparatus in fixing a toner image in monochromatic printing. The first method, which is disclosed in, for example, Japanese Unexamined Patent Publication No. 70571/1986, changes the set temperature for the heat roller in accordance with the type of printing (e.g., 190° C. for color printing and 180° C. for monochromatic printing).

The second method, which is disclosed in, for example, Japanese Unexamined Patent Publication No. 263173/1985, changes the set temperature and the amount of power for the pressure roller, while keeping the set temperature and the amount of power for the heat roller constant. According to this method, the set temperature and the amount of power for the pressure roller are increased for full-colored printing, and are decreased for monochromatic printing.

The above-described conventional apparatuses and methods have the following drawbacks.

The first conventional method increases the set temperature of the heat roller, located on the toner image side, for full-color printing in order to well melt the entire toner image. This is likely to cause a so-called offset phenomenon in which the toners on the surface of the recording medium stick on the heat roller. Accordingly, the heat roller becomes dirty, thereby staining the recording medium (sheet).

According to the second conventional method, the set temperature for the pressure roller, even if changed, contributes to melting the toners indirectly, but via the sheet, resulting in a lower heat efficiency for melting the toners. The heat roller therefore requires the energy that is necessary to melt the toners of a full-colored toner image. In monochromatic printing, therefore, the consumed power is reduced only by the amount equivalent to the decreased temperature of the pressure roller, and a significant reduction of the consumed power cannot be expected. Further, if the temperature of the pressure roller is changed, the fixed toner image contacts the pressure roller at the time of printing both sides so that the fixed toner image may be melted.

It is therefore an object of the present invention to provide a color image forming apparatus which can considerably reduce power consumption, while preventing an offset at the time of fixing a toner image.

It is another object of the present invention to provide a color image forming apparatus which can reduce the amount of power consumption needed for image fixation in accordance with the ambient temperature.

SUMMARY OF THE INVENTION

The aforementioned and other objects of the present invention are accomplished by providing a color image forming apparatus which forms a monochromatic toner image or a toner image in a plurality of colors and which can considerably reduce power consumption, while preventing an offset at the time of fixing a toner image. The color image forming apparatus includes a toner image forming device 3 for forming a monochromatic toner image or a toner image in a plurality of colors on a recording medium; first heating device 50, located on a toner image side of the recording medium, for fixing the toner image on the recording medium by heat; second heating device 54 located on an opposite side to the toner image side of the recording medium; and a controller 71 for making an amount of power supply to the second heating device 54 constant and changing an amount of power supply to the first heating device 50 depending on whether the toner image is monochromatic or is in a plurality of colors, while making a set temperature of the first heating means 50 constant.

DETAILED DESCRIPTION OF THE PREFERRED EMBODIMENT

Figure 1:
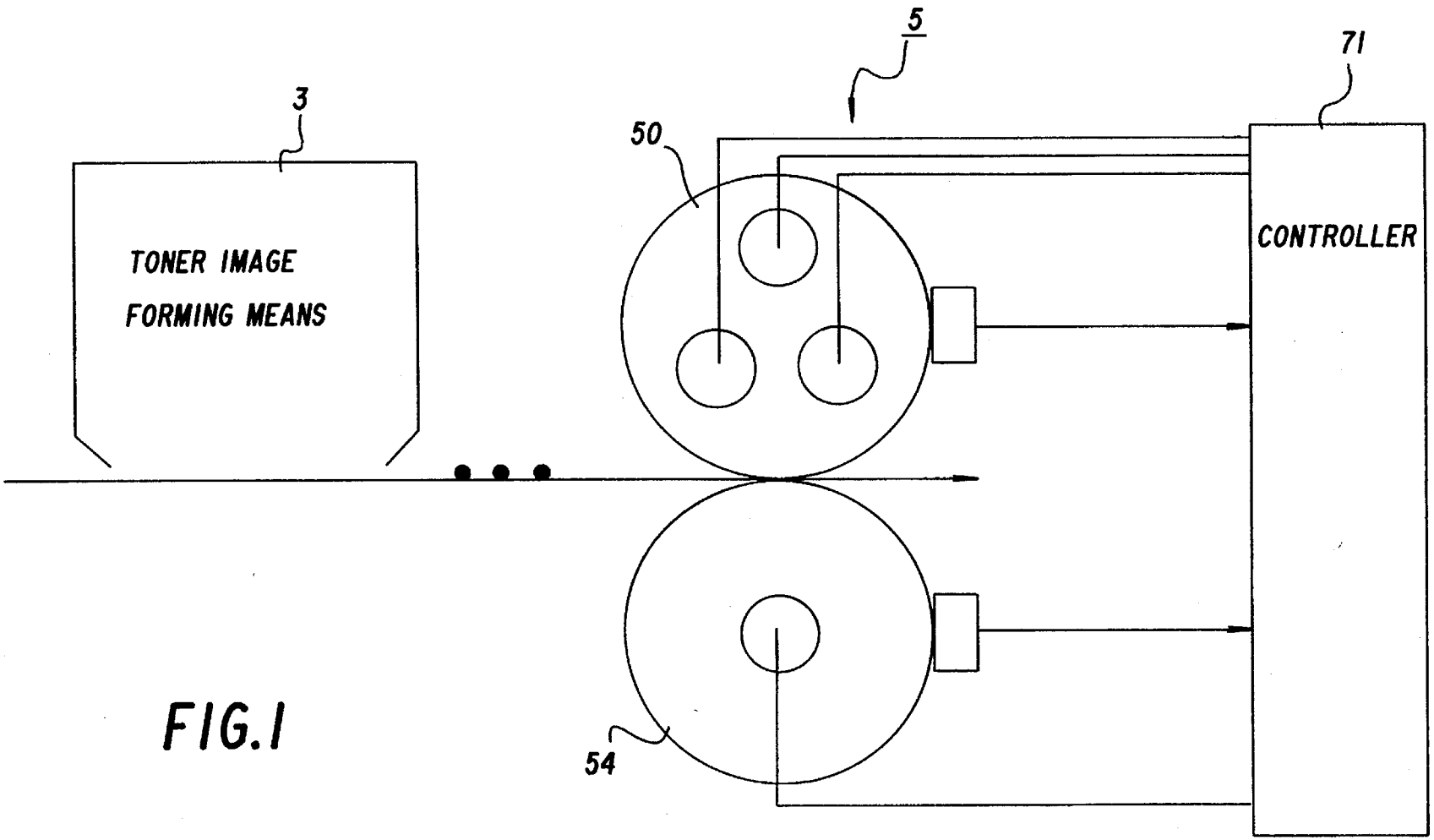
FIG. 1 is a diagram of the principle of the present invention.

FIG. 1 illustrates the principle embodied in the present invention.

This invention is provided with a color image forming apparatus which comprises a toner image forming device 3 for forming a monochromatic toner image or a toner image in a plurality of colors on a recording medium; first heating device 50, located on a toner image side of the recording medium, for fixing the toner image on the recording medium by heat; second heating device 54 located on an opposite side to the toner image side of the recording medium; and a controller 71 for making a power supply to the second heating device 54 constant, and for changing a power supply to the first heating device 50 based on whether the toner image is monochromatic or is in a plurality of colors, while making a set temperature of the first heating device 50 constant.

The first heating device 50 is a heat roller which includes a halogen lamp; and the second heating means 54 is a backup roller which includes a halogen lamp. The heat roller 50 is provided with a plurality of independently controllable halogen lamps 51*a*–51*c*. The halogen lamps 51*a*–51*c* may have different electric capacities, although these halogen lamps 51*a*–51*c* may have the same electric capacity. The heat roller 50 is provided with a single halogen lamp; and the controller 71 changes an input voltage to the halogen lamp.

Further, a temperature sensor 76 is provided to detect the ambient temperature of the apparatus; and the controller 71 controls the amount of power supply to the first heating device 50 in accordance with a temperature detected by the temperature sensor 76.

Moreover, the toner image forming device 3 forms the toner image on one surface of the recording medium. An inverting path 46 is provided to turn over the recording medium with the one surface thereof having undergone image fixation, and to return the recording medium to an entrance of the toner image forming device 3 in order to form a toner image on a back surface of the recording medium with the one surface thereof having undergone image fixation.

The present invention is concerned with the reduction of the fixing energy for monochromatic printing, and accomplishes this objective with the following structural arrangements and accompanying methods.

First, the set temperature of the first heating device 50 on the toner image side is controlled so as to be constant in order to prevent a toner offset to the first heating device 50. Secondly, the amount of power supply to the second heating device 54 is made constant, and the amount of power supply to the first heating device 50 is changed depending on whether the toner image is monochromatic or contains a plurality of colors. Since the image fixation is accomplished by the energy of the first heating device 50, the efficiency of image fixation with respect to the applied energy is high. The consumed power can therefore be reduced considerably. Since the amount of power consumption of the second heating device 54 does not change or the set temperature remains unchanged, it is possible to prevent the fixed toner image from melting even in the printing of both sides of the recording medium; and thus, prevent the disturbance of the image.

(a) Description of Color Image Forming Apparatus

Figure 2:
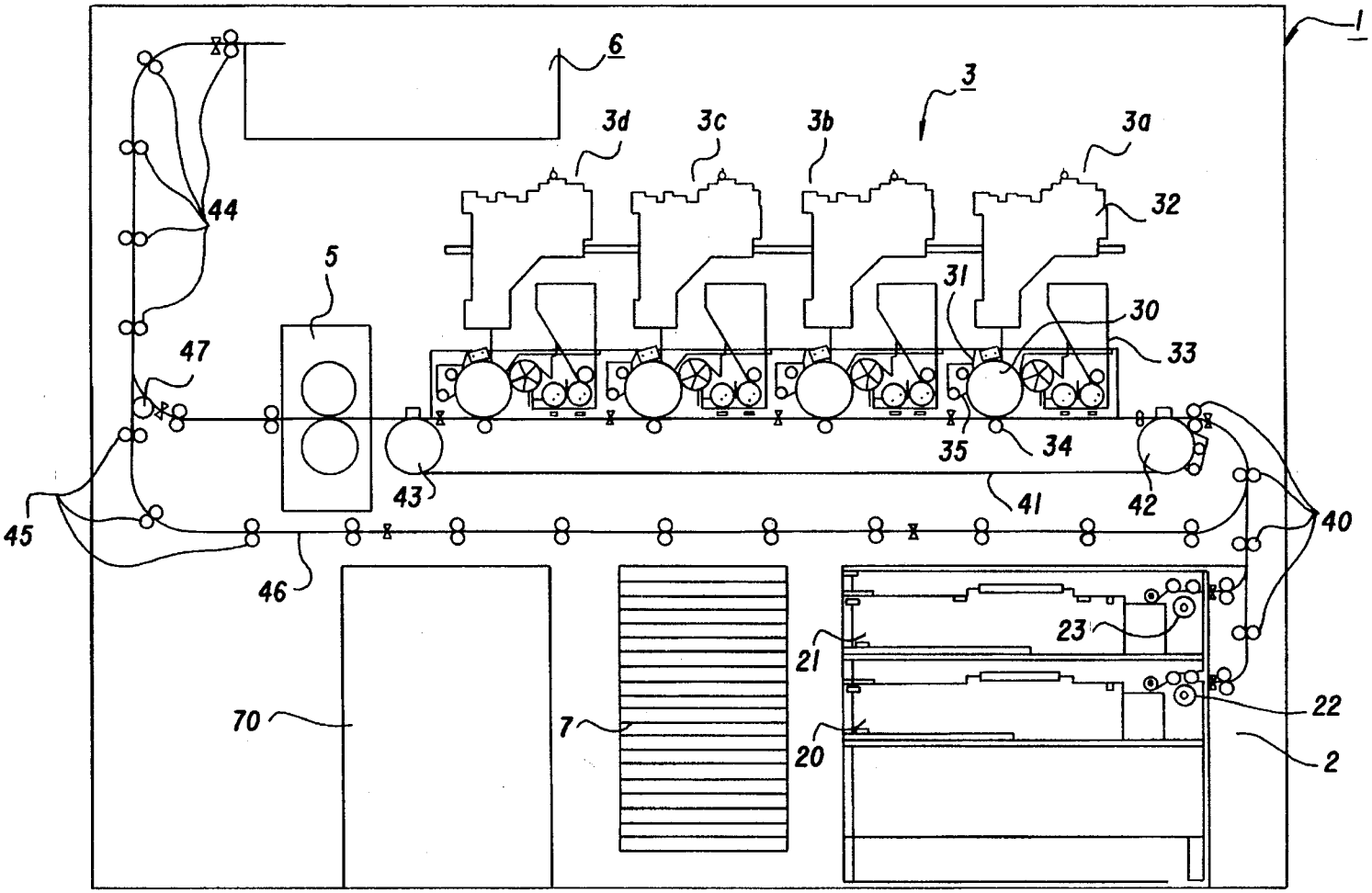
FIG. 2 is a diagram showing the structure of a color image forming apparatus according to one embodiment of the present invention.

FIG. 2 is a diagram showing the structure of a color image forming apparatus according to a first embodiment of the present invention. In this embodiment, the illustrated color image forming apparatus is a color electrophotographing printer.

As shown in FIG. 2, the color electrophotographing printer 1 has a hopper 2 for retaining sheets; an image forming unit 3 for forming a toner image on one side of a sheet; a sheet feeding system 4; a fixing unit 5 for fixing a toner image on a sheet; a stacker 6 for receiving discharged sheets; a control circuit 7; and a power supply 70.

The hopper 2 has two sheet cassettes 20, 21 one over the other. The sheet cassettes 20, 21 are attachable to and detachable from the apparatus from the front side. Pickup units 22 and, 23 respectively pick up sheets from the sheet cassettes 20 and, 21 one by one. The image forming unit 3 has electrophotographing mechanisms 3*a*, 3*b*, 3*c*, 3*d* which form toner images of magenta, yellow, blue and black, respectively.

Each of the electrophotographing mechanisms 3*a* to 3*d* has a photosensitive drum 30, a precharger 31, a laser optical system 32, a developing unit 33, a transfer roller 34 and a de-electrifier and cleaner 35. The photosensitive drum 30 has a photosensitive layer formed around a metal drum and rotates clockwise. The precharger 31 evenly charges the photosensitive drum 30. The laser optical system 32 exposes the photosensitive drum 30 image light to form an electrostatic latent image on the drum 30. The developing unit 33 supplies a developer to the photosensitive drum 30 in order to develop the electrostatic latent image; consequently, forming a toner image. The transfer roller 34 transfers the toner image on the photosensitive drum 30 onto a conveyed sheet. The de-electrifier and cleaner 35 remove the residual charges off the photosensitive drum 30 and then remove the residual toners.

The individual developers 30 of the electrophotographing mechanisms 3*a* to 3*d*, respectively, retain the magenta developer, yellow developer, blue developer and black developer; and supply these developers to the photosensitive drum 30.

The sheet feeding system 4 is provided with feed rollers 40 for feeding sheets from the sheet cassettes 20, 21 to the entrance of the image forming unit 3. This system 4 is further provided with a belt conveying mechanism 41, 42, 43 for conveying a sheet from the entrance of the image forming unit 3 to the exit. This belt conveying mechanism has an electrostatic adhesion belt 41 placed around a pair of rollers 42, 43. Sheets are conveyed from the entrance of the image forming unit 3 to the exit by this belt 41 which is moved by the rollers 42, 43. The use of this electrostatic adhesion belt 41 can minimize the positional deviation of a sheet at the image transfer position in each of the electrophotographing mechanisms 3*a* to 3*d*.

The sheet conveying system 4 further has discharge rollers 44 provided at the subsequent stage of the fixing unit 5 to feed a sheet from the fixing unit 5 to the stacker 6. Also provided is a mechanism for accomplishing double-sided printing. More specifically, an inverting path 46 is provided to feed a sheet from the subsequent stage of the fixing unit 5 to the entrance of the image forming unit 3. This inserting path 46 is provided with many feed rollers 45. An inverting impeller 47 is also provided at the subsequent stage of the fixing unit 5.

The operation of the printer of this invention will now be described. After a sheet is fed out from the sheet cassette 20, 21 by the pickup mechanism 22 or 23, a sheet is fed to the entrance of the image forming unit 3 by the feed rollers 40. This sheet is conveyed through the electrophotographing mechanisms 3*a*, 3*b*, 3*c*, 3*d* by the belt conveying mechanism 41, 42, 43. During this conveyance, the toner images of individual colors on the photosensitive drums 30 of the electrophotographing mechanisms 3*a*–3*d* are transferred on one side of the sheet by the transfer rollers 34. The sheet is then supplied to the fixing unit 5 where the toner images are thermally fixed. The sheet carrying the fixed toner images is fed toward the stacker 6 by the discharge rollers 44.

In order to execute a double-sided printing, when the trailing edge of a sheet reaches the impeller 47, the feeding of the sheet is stopped. Then, the impeller 47 is rotated counterclockwise in order to direct the trailing edge of the sheet toward the inverting path 46. The discharge rollers 44 are then rotated in the reverse direction and the feed rollers 45 are then rotated so that the sheet is fed toward the entrance of the image forming unit 3 along the inverting path 46. The sheet that has reached the entrance of the image forming unit 3 is conveyed through the electrophotographing mechanisms 3*a*, 3*b*, 3*c*, 3*d* by the belt conveying mechanism 41, 42, 43. During this conveyance, the toner images of individual colors on the photosensitive drums 30 of the electrophotographing mechanisms 3*a*–3*d* are transferred on the opposite side of the sheet by the transfer rollers 34. The sheet is then supplied to the fixing unit 5 in order to thermally fix the toner images. The sheet that has undergone the image fixation is then fed towards the stacker 6 by the discharge rollers 44. The double-sided printing is carried out in this manner.

In order to execute one-sided printing, after printing is done on one side of a sheet, the sheet is discharged to the stacker 6 by the discharge rollers 44.

With the above-described structural arrangement, as a sheet is turned over for double-sided printing by utilizing the space between the hopper 2 and the image forming unit 3, the double-sided color printing apparatus can be designed in a compact manner. In addition, since the feeding path from the hopper 2 to the stacker 6 has an S shape, the color printing apparatus can be made compact. Furthermore, the use of the electrostatic adhesion belt 41 can ensure the formation of a color image with less mismatching of different colors.

Figure 3:
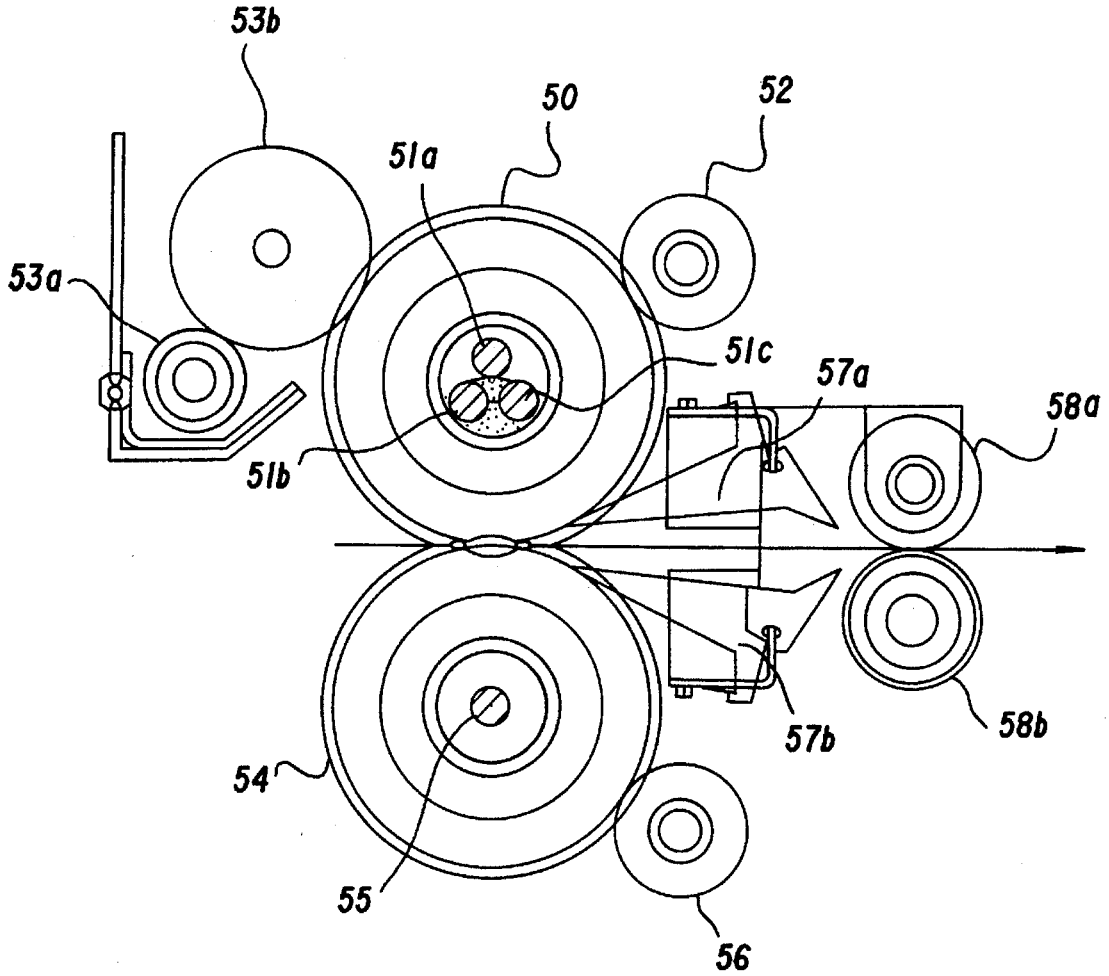
FIG. 3 is a diagram showing the structure of a fixing unit in FIG. 2.

FIG. 3 illustrates the structure of the fixing unit according to this embodiment of the present invention. In FIG. 3, sheets are fed rightward regardless of the layout in FIG. 2.

Further, in FIG. 3, a heat roller 50 incorporates three halogen lamps 51*a*, 51*b*, 51*c* as heaters. A cleaning roller 52 cleans stains on the heat roller 50. Oil supply rollers 53*a* and 3*b* supply a lubricating oil to the heat roller 50.

A backup roller (pressure roller) 54 includes a single halogen lamp 55 as a heater. This pressure roller 54 is pressed against the heat roller 50 in order to feed a sheet placed between both rollers 50, 54. A cleaning roller 56 cleans stains on the pressure roller 54. Separation pawls 57*a*, 57*b* serve to prevent a sheet from tangling around the heat roller 50 and the pressure roller 54, respectively. Discharge rollers 58*a*, 58*b* serve to discharge a sheet carrying a fixed image.

(b) Description of the First Embodiment

Figure 4:
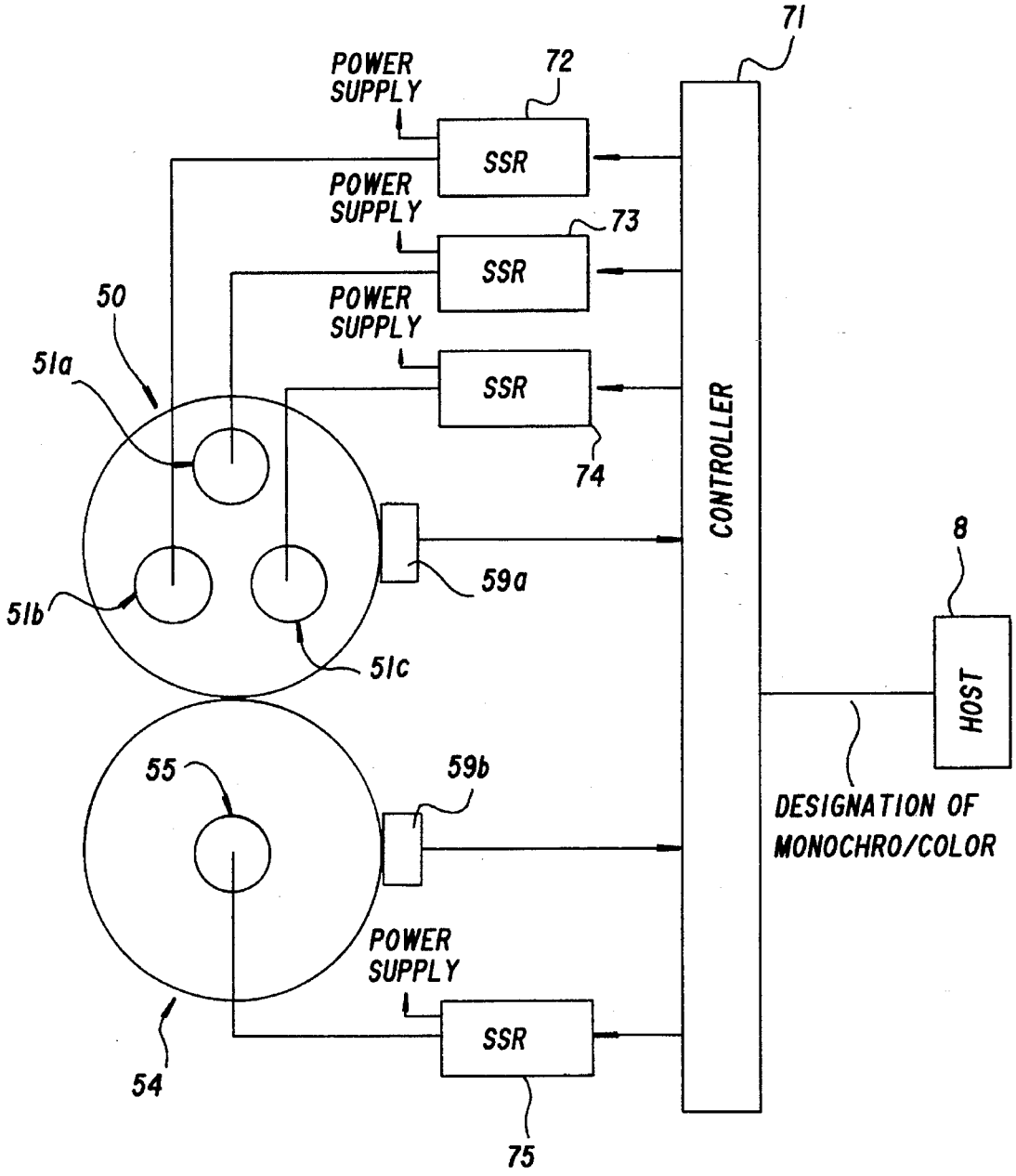
FIG. 4 is a control block diagram for the first embodiment of the present invention.

FIG. 4 is a control block diagram for the first embodiment of the present invention.

In reference to FIG. 4, a temperature sensor 59*a*, which includes a thermistor, detects the temperature of the heat roller 50. A temperature sensor 59*b*, which includes a thermistor, detects the temperature of the pressure roller 54. A controller 71, which includes a microprocessor, controls the individual sections of the above-described electrophotographing mechanisms 3*a* to 3*d*, and controls the halogen lamps 51*a* to 51*c* of the heat roller 50 of the fixing unit 5 and the halogen lamp 55 of the pressure roller 54.

Set/reset switch circuits 72, 73, 74, 75 apply voltages from the power supply to the associated halogen lamps 51*a*–51*c* and 55 in response to an instruction from the controller 71. A host computer 8 instructs the controller 71 to execute monochromatic printing or color printing, and transfers print data to the controller 71.

Figure 5A:
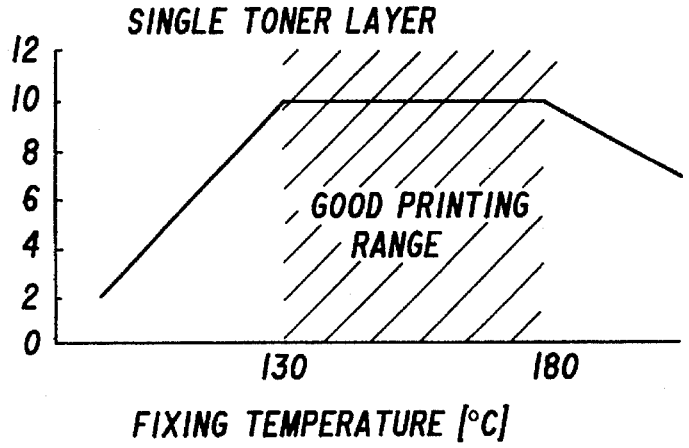
FIG. 5A, 5B and 5C are explanatory diagrams for the set temperature of a heat roller depending on the type of toner layer employed.
Figure 5B:
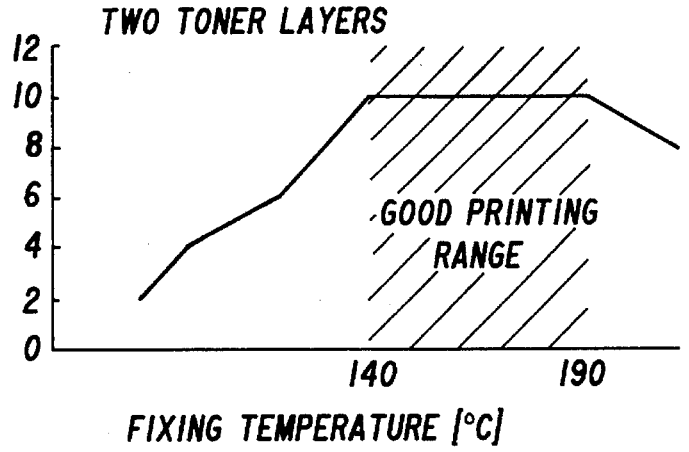
Figure 5C:
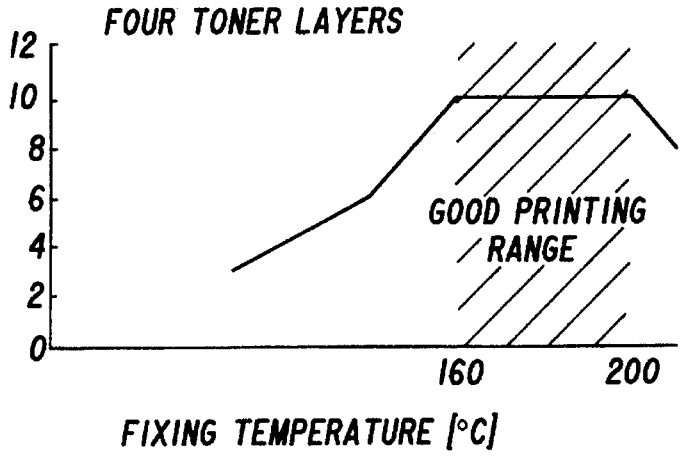
Figure 6:
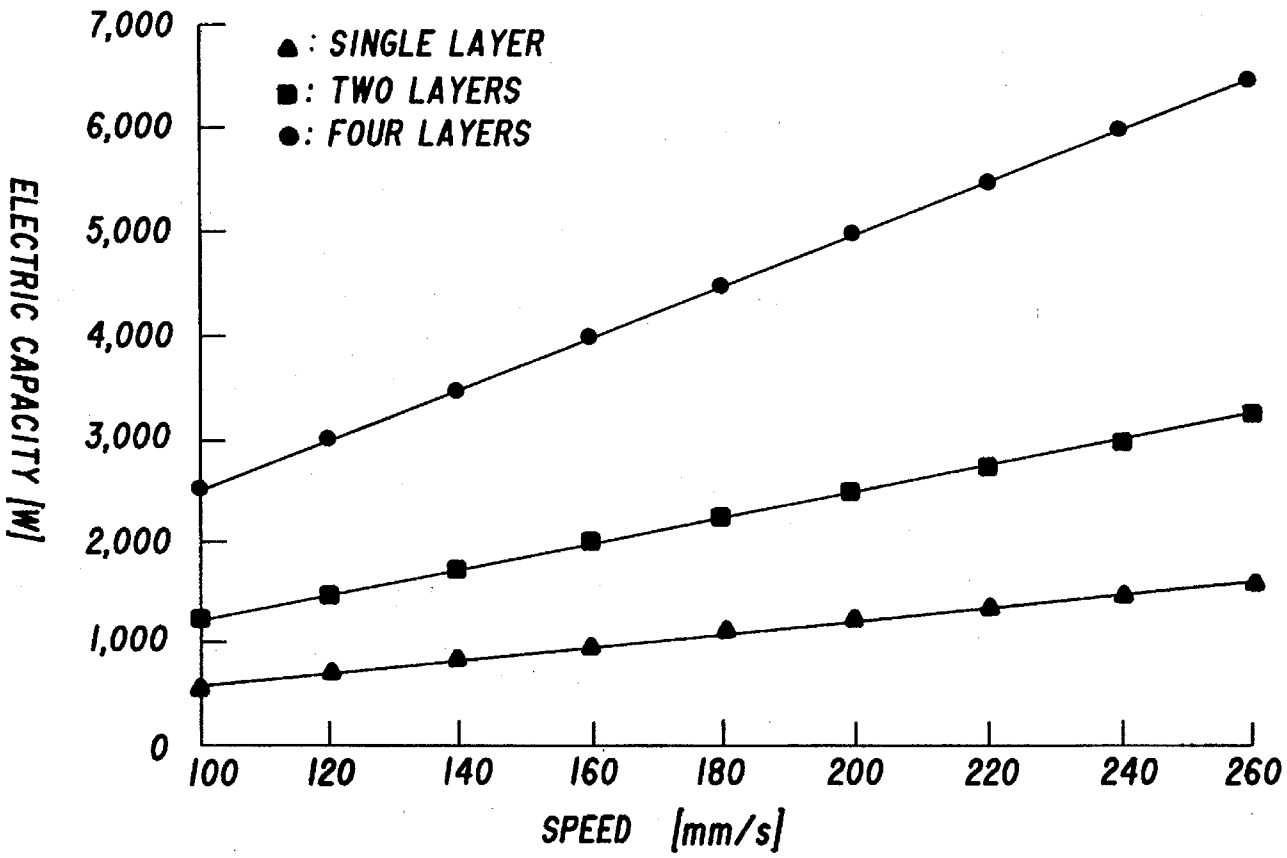
FIG. 6 is a diagram showing the relationship between the printing speed and the electric capacity.

FIG. 5A, 5B and 5C are explanatory diagrams for the set temperature of the heat roller for a single toner layer, two toner layers and four toner layers, respectively; and FIG. 6 is a diagram showing the relationship between the printing speed and the electric capacity.

As shown in FIG. 5A, for a single toner layer as in monochromatic printing, improper fixing occurs when the fixing temperature is 130° C. or below, and an offset occurs when the fixing temperature is 180° C. or above. The fixing temperature should therefore be between 130° C. and 180° C. As illustrated in FIG. 5B, for two toner layers (as multicolored printing), improper fixing occurs when the fixing temperature is 140° C. or below; and an offset occurs when the fixing temperature is 190° C. or above. The fixing temperature should therefore be between 140° C. and 190° C.

As shown in FIG. 5C, for four toner layers (as in full-color printing), improper fixing occurs when the fixing temperature is 160° C. or below; and an offset occurs when the fixing temperature is 200° C. or above. The fixing temperature should therefore be between 160° C. and 200° C.

In view of the above, image fixation can be properly executed regardless of the thickness of the toner layer as long as the fixing temperature falls within the range of 160° C. to 180° C. In other words, image fixation can be accomplished properly by keeping the set temperature constant.

In reference to FIG. 6, the amount of power needed for the fixing energy for each toner layer thickness is obtained. In FIG. 6, the illustrated triangles indicate the case of a single toner layer; rectangles indicate the case of two toner layers; and circles indicate the case of four toner layers. As apparent from FIG. 6, with the printing speed of 180 mm/s, the required power is 1125 W for a single toner layer, 2250 W for two toner layers, and 4500 W for four toner layers.

According to this embodiment, therefore, one halogen lamp 51*a* of 450 W, one halogen lamp 51*b* of 1550 W, and one halogen lamp 51*c* of 1800 W are provided in the heat roller 50 located on the side of a sheet which has not undergone toner-image fixation, as shown in FIG. 4. One halogen lamp 55 of 700 W is provided in the pressure roller 54 located on the opposite side.

Figure 7:
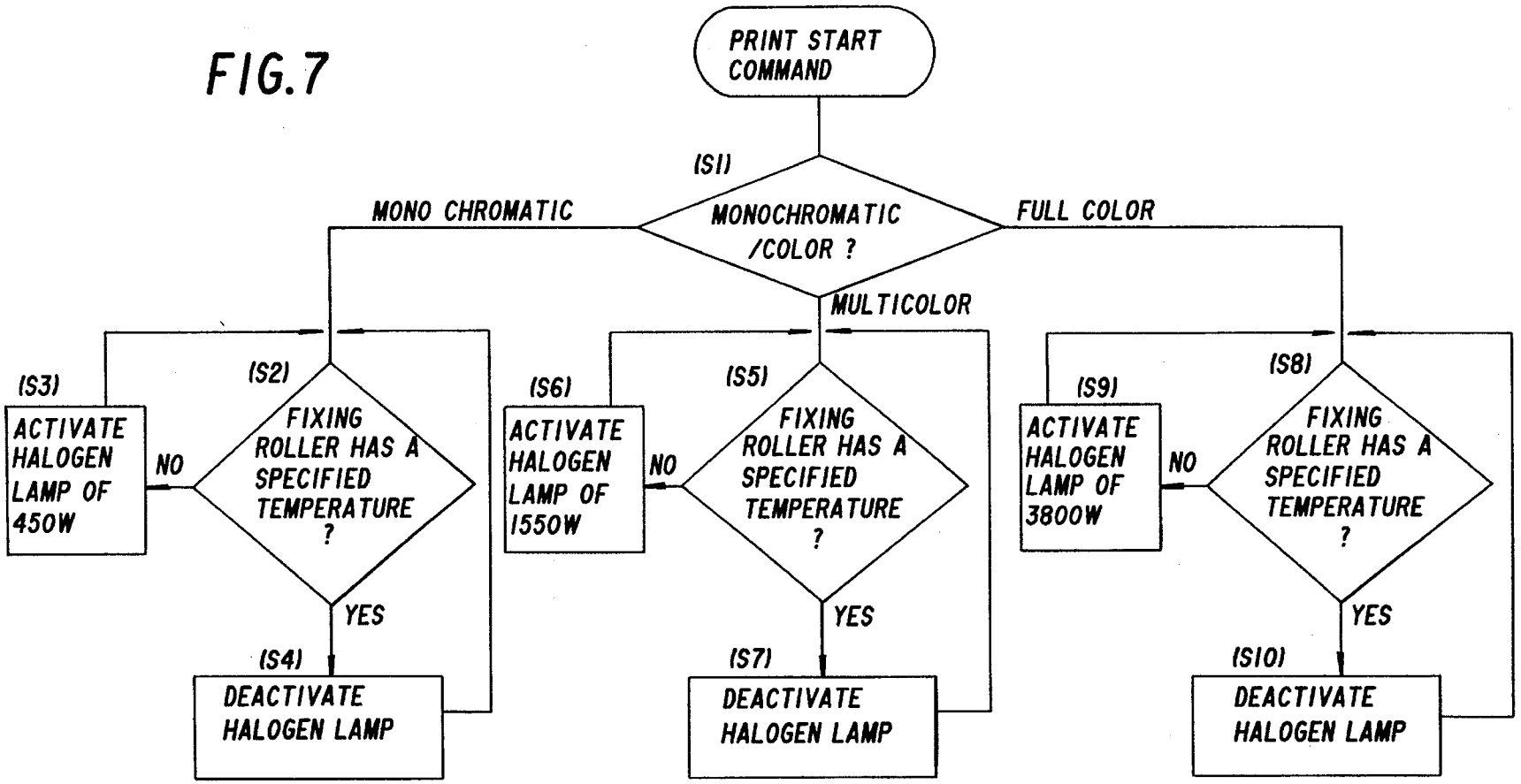
FIG. 7 is a flowchart illustrating operations relating to the heat roller according to the first embodiment.
Figure 8:
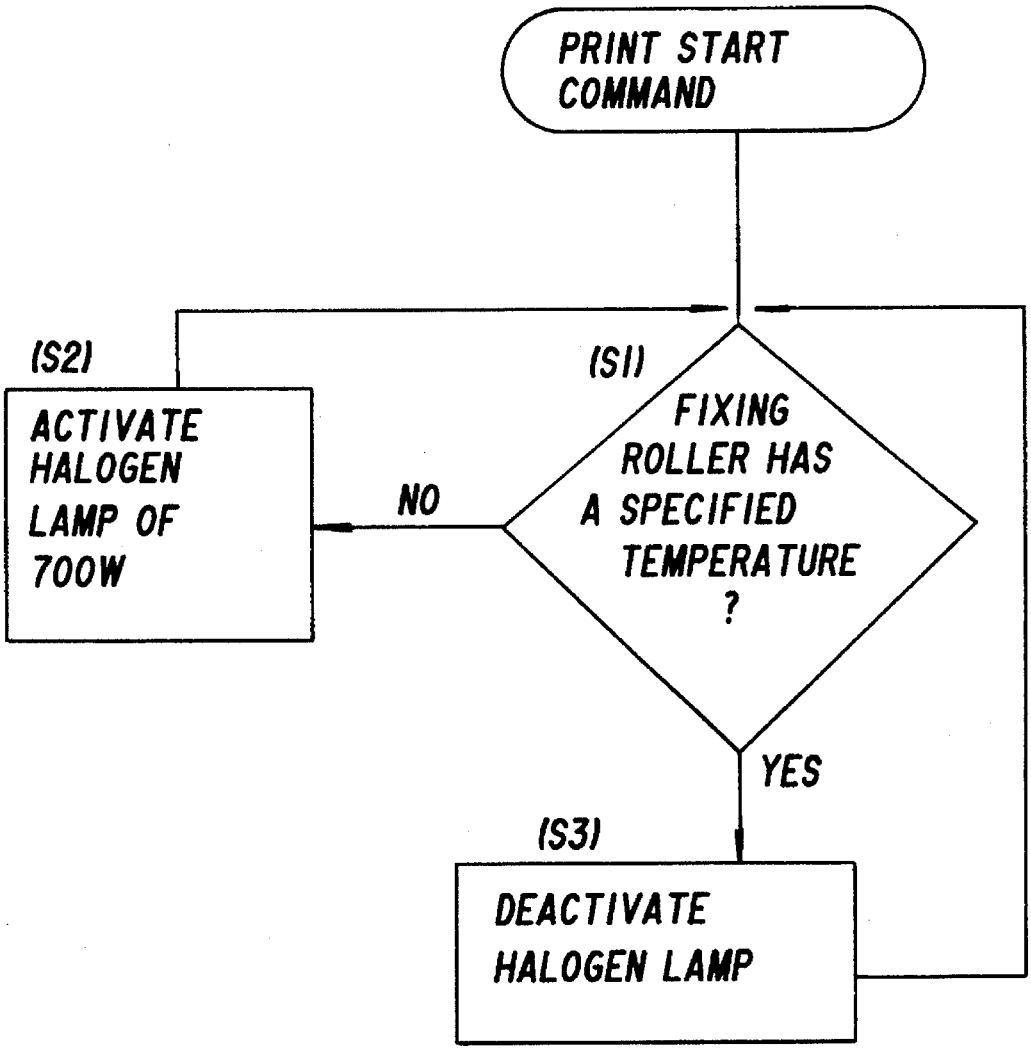
FIG. 8 is a flowchart illustrating operations relating to the backup roller according to the first embodiment.
Figure 9:
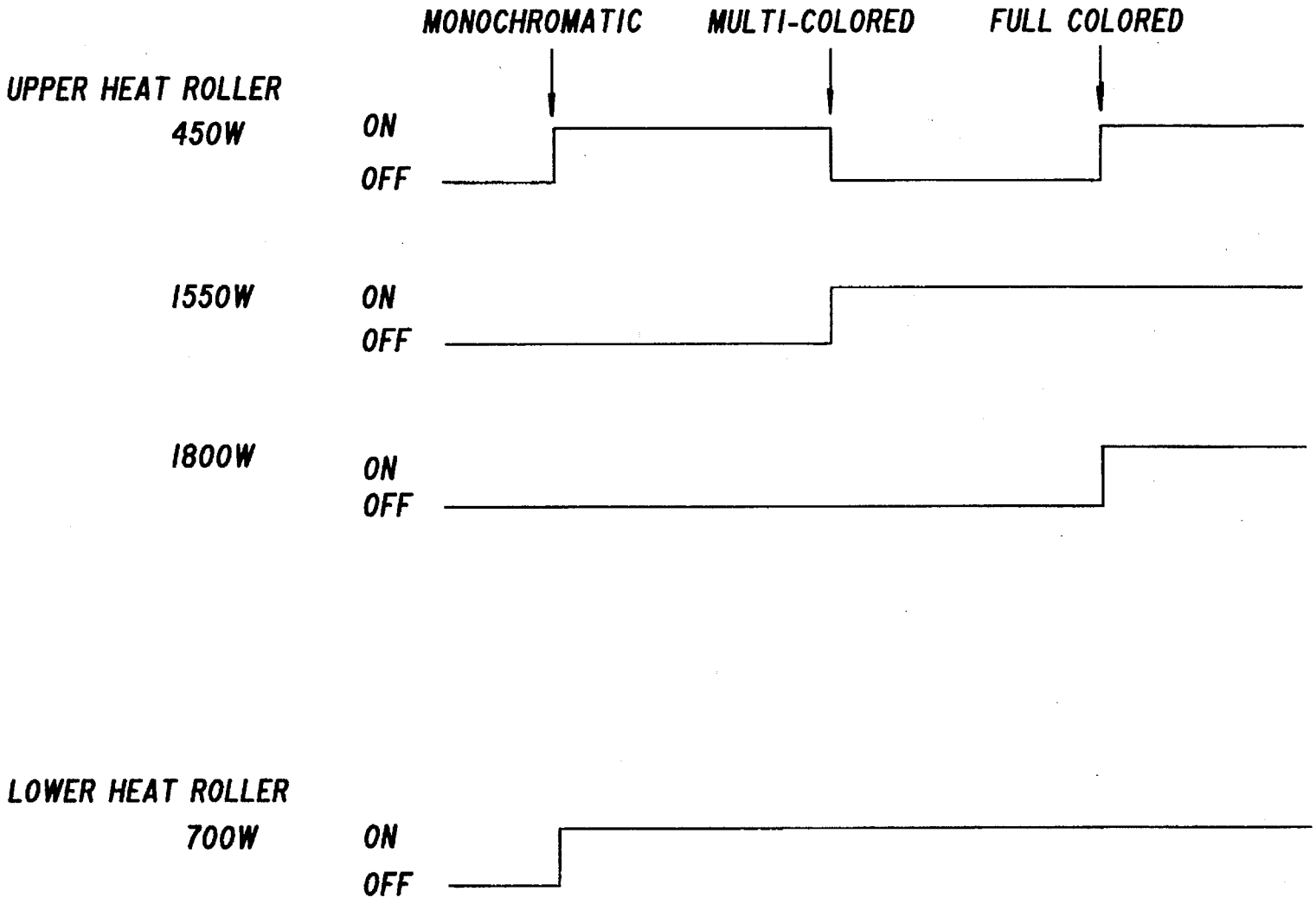
FIG. 9 is an explanatory diagram for a fixing operation according to the first embodiment.

FIG. 7 is a flowchart illustrating procedures for the heat roller, according to the first embodiment of the present invention. FIG. 8 is a flowchart illustrating operations relating to the pressure roller according to the first embodiment. FIG. 9 is an explanatory diagram for a fixing operation according to the first embodiment.

The fixing control for the heat roller 50 is discussed hereinafter in reference to FIG. 7.

(S1) When receiving a print start instruction from the host computer 8, the controller 71 determines whether the host computer 8 has instructed monochromatic printing, multicolored printing or full-colored printing.

(S2) When determining that monochromatic printing has been instructed, the controller 71 checks the detected temperature of the temperature sensor 59*a* of the heat roller 50.

(S3) When the detected temperature is not a specified temperature (e.g., 170° C.), the controller 71 sets the set/reset switch circuit 73 to apply a voltage to the halogen lamp 51*a* of 450 W. As a result, the halogen lamp 51*a* heats up and generates heat of 450 W. As described later in reference to FIG. 8, the halogen lamp 55 of the pressure roller 54 generates heat of 700 W at this time so that the total amount of heat becomes 1150 W which can melt a single layer of toners as previously described in reference to FIG. 6. The controller 71 then returns to step S2.

(S4) When the detected temperature is equal to or above the specified temperature (e.g., 170° C.), on the other hand, the controller 71 resets the set/reset switch circuit 73 to stop applying a voltage to the 450 W halogen lamp 51*a*. As a result, the halogen lamp 51*a* is turned off. The controller 71 then returns to step S2.

(S5) When determining in step S1 that multicolored printing has been instructed, the controller 71 checks the detected temperature of the temperature sensor 59*a* of the heat roller 50.

(S6) When the detected temperature is not at a specified temperature (e.g., 170° C.), the controller 71 sets the set/reset switch circuit 72 to apply a voltage to the halogen lamp 51*b* of 1550 W. As a result, the halogen lamp 51*b* heats up and generates heat of 1550 W. As described later in reference to FIG. 8, the halogen lamp 55 of the pressure roller 54 generates heat of 700 W at this time so that the total amount of heat becomes 2250 W which can melt two toner layers as previously described in reference to FIG. 6. The controller 71 then returns to step S5.

(S7) When the detected temperature is equal to or above the specified temperature (e.g., 170° C.), on the other hand, the controller 71 resets the set/reset switch circuit 72 to stop applying a voltage to the 1550 W halogen lamp 51*b*. As a result, the halogen lamp 51*b* is turned off. The controller 71 then returns to step S5.

(S8) When determining, in step S1, that full-colored printing has been instructed, the controller 71 checks the detected temperature of the temperature sensor 59*a* of the heat roller 50.

(S9) When the detected temperature is not a specified temperature (e.g., 170° C.), the controller 71 sets the set/reset switch circuits 73, 72, 74 to apply voltages to the three halogen lamps 51*a*, 51*b*, 51*c* of 450 W, 1550 W and 1800 W, respectively. As a result, the halogen lamps 51*a*, 51*b*, 51*c* heat up and generate heat of 3800 W. As described later in reference to FIG. 8, the halogen lamp 55 of the pressure roller 54 generates heat of 700 W at this time so that the total amount of heat becomes 4500 W which can melt four toner layers as previously described in reference to FIG. 6. The controller 71 then returns to step S8.

(S10) When the detected temperature is equal to or above the specified temperature (e.g., 170° C.), on the other hand, the controller 71 resets the set/reset switch circuits 73, 72 and 74 to stop applying voltages to the three halogen lamps 51*a*, 51*b*, 51*c* of 450 W, 1550 W and 1800 W, respectively. As a result, the halogen lamps 51*a*, to 51*c* are turned off. The controller 71 then returns to step S8.

The heating process of the pressure roller 54 is discussed hereinafter in reference to FIG. 8.

(Sl) When receiving a print start instruction from the host computer 8, the controller 71 checks the detected temperature of the temperature sensor 59*b* of the pressure roller 54.

(S2) When the detected temperature is not a specified temperature (e.g., 170° C.), the controller 71 sets the set/reset switch circuit 75 to apply a voltage to the halogen lamp 55 of 700 W. As a result, the halogen lamp 55 heats up and generates heat of 700 W. The controller 71 then returns to step S1.

(S3) When the detected temperature is equal to or above the specified temperature (e.g., 170° C.), on the other hand, the controller 71 resets the set/reset switch circuit 75 to stop applying a voltage to the 700 W halogen lamp 55. As a result, the halogen lamp 55 is turned off. The controller 71 then returns to step S1.

This operation is illustrated as a time chart in FIG. 9. When a printing instruction is received, the pressure roller (lower heat roller) 54 generates heat of 700 W. When monochromatic printing is instructed, the heat roller (upper heat roller) 50 generates heat of 450 W. On the other hand, when multicolored printing is instructed, the heat roller (upper heat roller) 50 generates heat of 1550 W. When full-colored printing is instructed, the heat roller (upper heat roller) 50 generates heat of 3800 W.

As the amount of heat from the heat roller 50 is changed, in accordance with the printing mode and while generating a constant amount of heat from the pressure roller 54, the efficiency of melting toners is improved in order to significantly reduce the consumed power. Due to the constant amount of heat generated from the pressure roller 54, a fixed toner image on one side of a sheet is not disturbed in a double-sided printing. Further, since the temperature of the heat roller 50 is constant, an offset can be prevented.

The halogen lamps have different electric capacities which are determined in accordance with the minimum capacities necessary for different printing modes according to this embodiment. This is the most advantageous from the viewpoint of reducing the consumed power.

(c) Description of the Second Embodiment

While the halogen lamps *a*, 51*b*, 51*c* of the heat roller 50 have different electric capacities from one another in the first embodiment, the reduction of the consumed power can also be achieved if the three halogen lamps *a*, 51*b*, 51*c* have the same electric capacity.

For instance, the halogen lamps 51*a*, 51*b*, 51*c* (each being a 1300 W halogen lamp) are provided in the heat roller 50. The halogen lamp 51*a*, alone is applied with a voltage in monochromatic printing that involves a single toner layer. The two halogen lamps 51*a*, 51*b* are applied with a voltage in multicolored printing that involves two toner layers. All three halogen lamps *a*, 51*b*, 51*c* are applied with a voltage in full-colored printing that involves four toner layers. At this time, the halogen lamp 55 of the pressure roller 54 always generates heat of 700 W regardless of the printing mode.

If the halogen lamps of the heat roller have the same electric capacity, the effect of reducing the consumed power becomes slightly lower than that of the first embodiment, but the use of the same components will reduce the manufacturing cost.

(d) Description of the Third Embodiment

Although three halogen lamps are provided in the heat roller 50 in the first and second embodiments, the same purpose can be achieved by a single halogen lamp. In this case, the input voltage to the halogen lamp is selectively changed. For example, a single halogen lamp is applied with a voltage for 450 W in monochromatic printing that involves a single toner layer. The halogen lamp is applied with a voltage for 1550 W in multicolored printing that involves two toner layers. The halogen lamp is applied with a voltage for 3800 W in full-colored printing that involves four toner layers. At this time, the halogen lamp 55 of the pressure roller 54 always generates heat of 700 W regardless of the printing mode.

As the halogen lamp with an input voltage which can be selectively changed is used in this embodiment, the number of the halogen lamps to be mounted in the fixing unit can be reduced.

(e) Description of Fourth Embodiment

Figure 10:
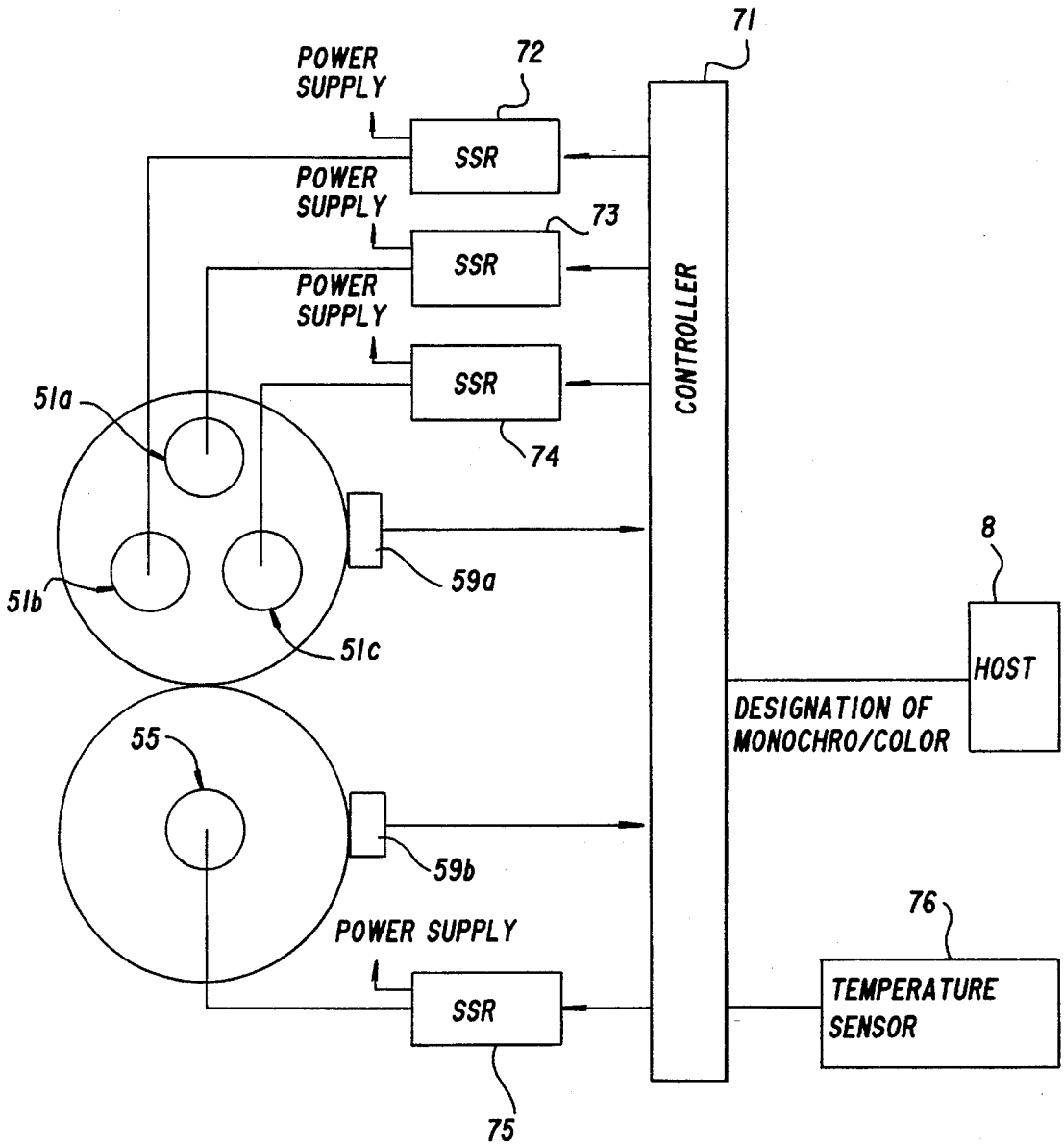
FIG. 10 is a control block diagram for a fourth embodiment of the present invention.

FIG. 10 illustrates a control block diagram for a fourth embodiment of the present invention.

The same components as shown in FIG. 4 are denoted by the same reference numerals or symbols in FIG. 10. In reference to FIG. 10, a temperature sensor 59*a*, which includes a thermistor, detects the temperature of the heat roller 50. A temperature sensor 59*b*, having a thermistor, detects the temperature of the pressure roller 54. A controller 71, which includes a microprocessor, controls the individual sections of the above-described electrophotographing mechanisms 3*a* to 3*d*, and controls the halogen lamps 51*a*, to 51*c* of the heat roller 50 of the fixing unit 5 and the halogen lamp 55 of the pressure roller 54.

Set/reset switch circuits 72, 73, 74, 75 apply voltages from the power supply to the associated halogen lamps 51*a*–51*c* and 55 in response to an instruction from the controller 71. An ambient temperature sensor 76, having a thermistor, detects the ambient temperature of the fixing unit. This ambient temperature sensor 76 is, for example, provided above the fixing unit 5 in the apparatus, for example. A host computer 8 instructs the controller 71 to execute monochromatic printing or color printing, and transfers print data to the controller 71.

Figure 11:
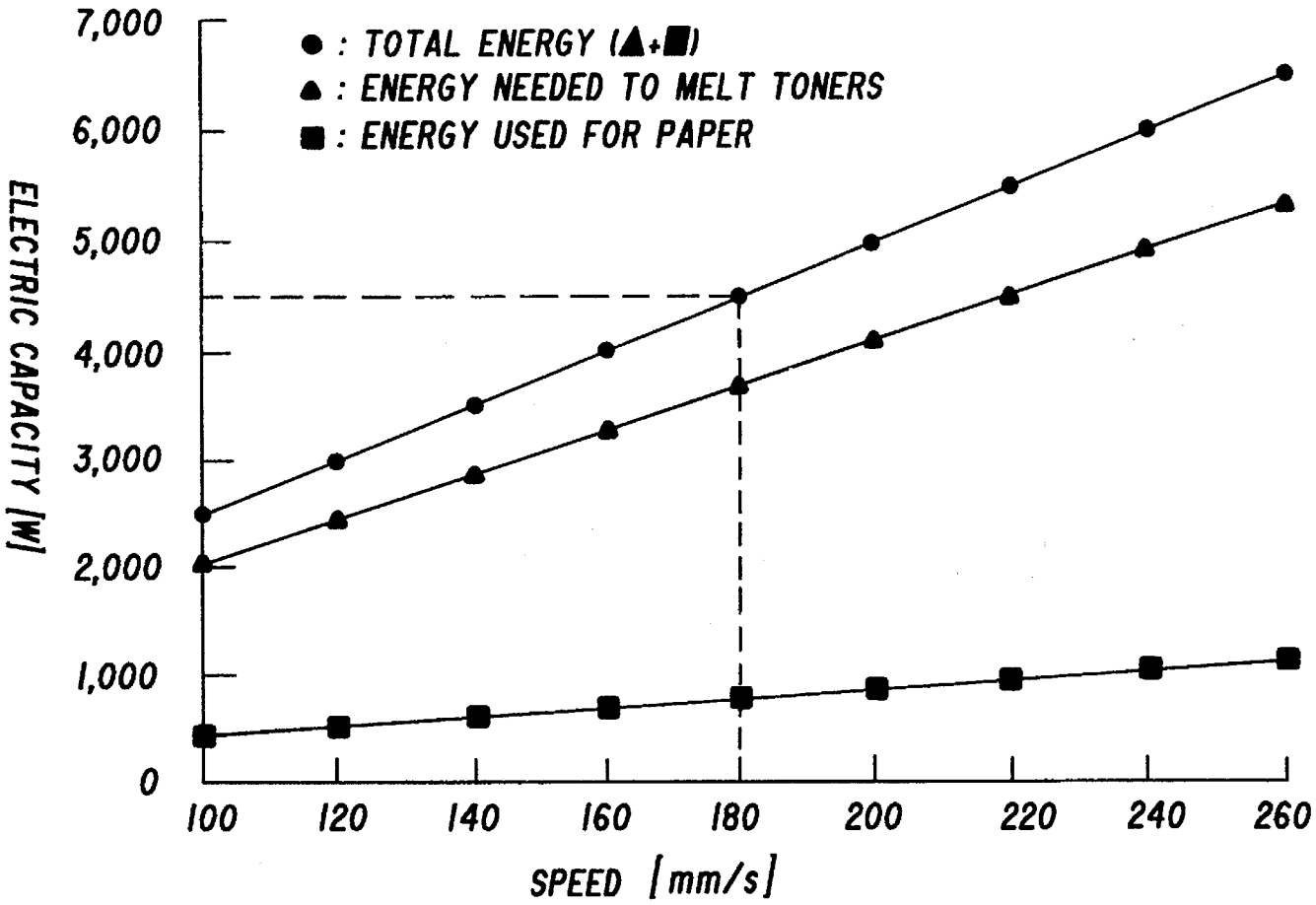
FIG. 11 is an explanatory diagram for the electric capacities when the ambient temperature is 0° C.
Figure 12:
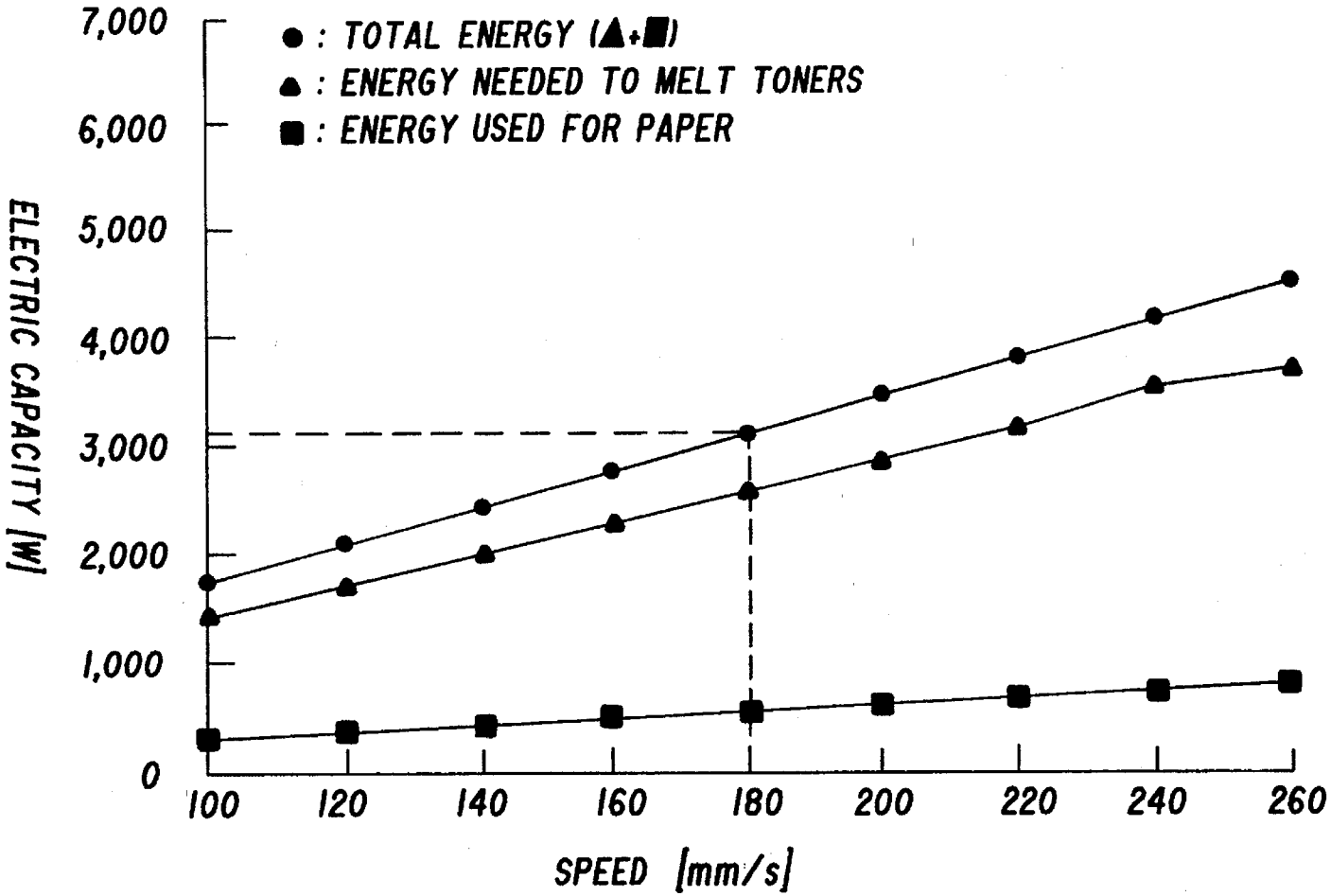
FIG. 12 is an explanatory diagram for the electric capacities when the ambient temperature is 30° C.
Figure 13:
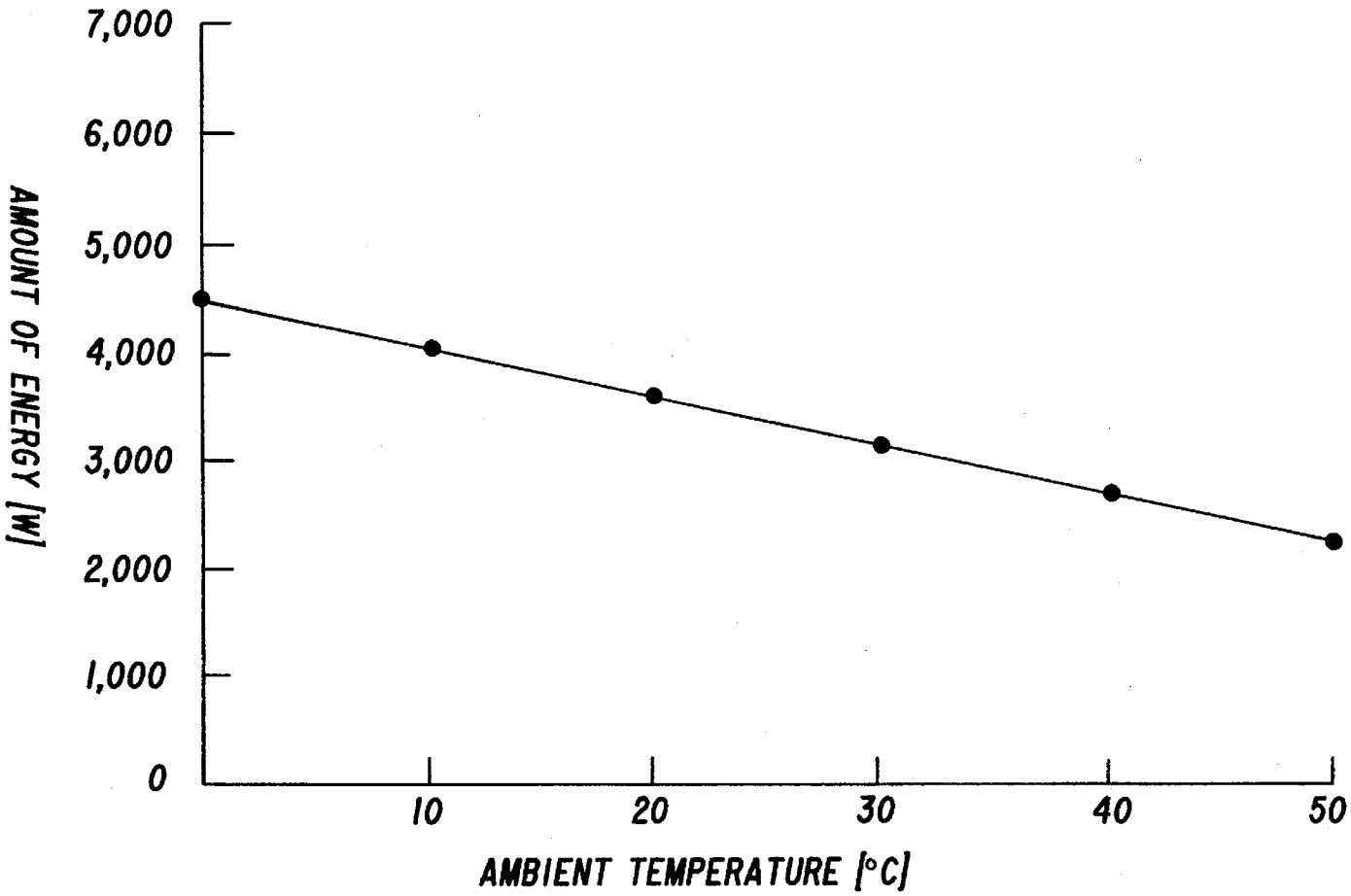
FIG. 13 is an explanatory diagram for the amounts of power needed for individual ambient temperatures.

FIG. 11 is an explanatory diagram of the electric capacities when the ambient temperature is 0° C. FIG. 12 is an explanatory diagram of the electric capacities when the ambient temperature is 30° C. FIG. 13 is an explanatory diagram of the amounts of power needed for individual ambient temperatures.

In the foregoing description of the first embodiment, it was described that heat of 4500 W is needed for a full-colored printing. This amount of heat, however, differs depending on the ambient temperature of the fixing unit. In this embodiment, the amount of applied heat in full-colored printing is changed in accordance with the ambient temperature to further reduce the consumed power.

In FIG. 11 and 12, the necessary energy is plotted by circles; the energy necessary to melt toners is plotted by triangles; and the energy absorbed in paper is plotted by rectangles. As shown in FIG. 11, with the printing speed of 180 mm/s, the necessary energy is 4500 W for the ambient temperature of 0° C. When the ambient temperature is 30° C., however, the necessary energy decreases to 3200 W with the printing speed of 180 mm/s, as shown in FIG. 12. This is due to the fact that the sheets and toners are warmed up at that temperature; subsequently, a lower energy is needed for printing. That is, the amount of power is 4500 W when the ambient temperature is between 0° C. to 20° C. The amount of power required for the ambient temperature of 15° C. to 30° C. is 3820 W; and the amount of power required for the ambient temperature of 30° C. or above is 3150 W.

The amount of required power decreases as the ambient temperature rises as shown in FIG. 13. This phenomenon is employed in order to further reduce the consumed power.

Figure 14:
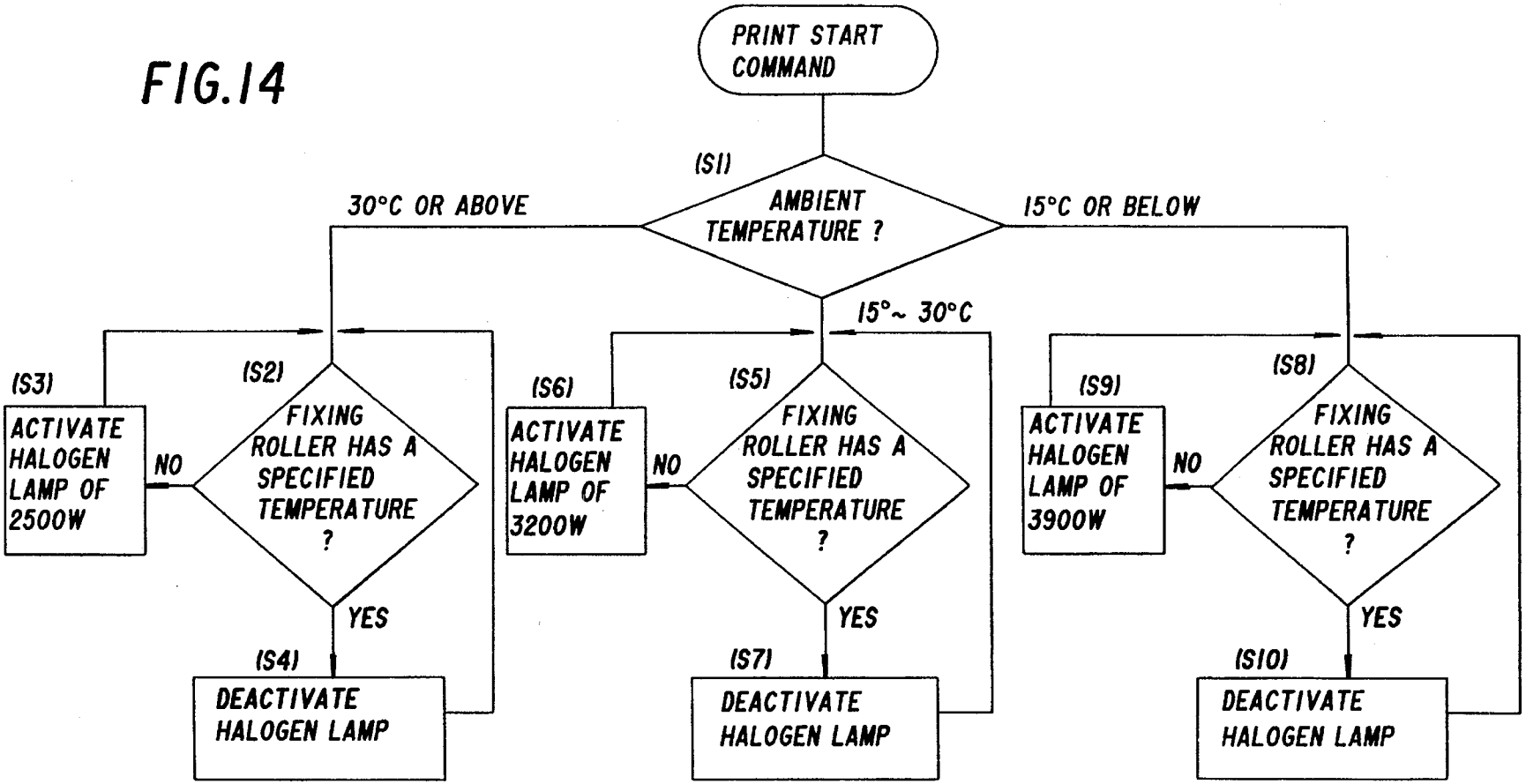
FIG. 14 is a flowchart illustrating procedures for the heat roller according to the fourth embodiment of the present invention.
Figure 15:
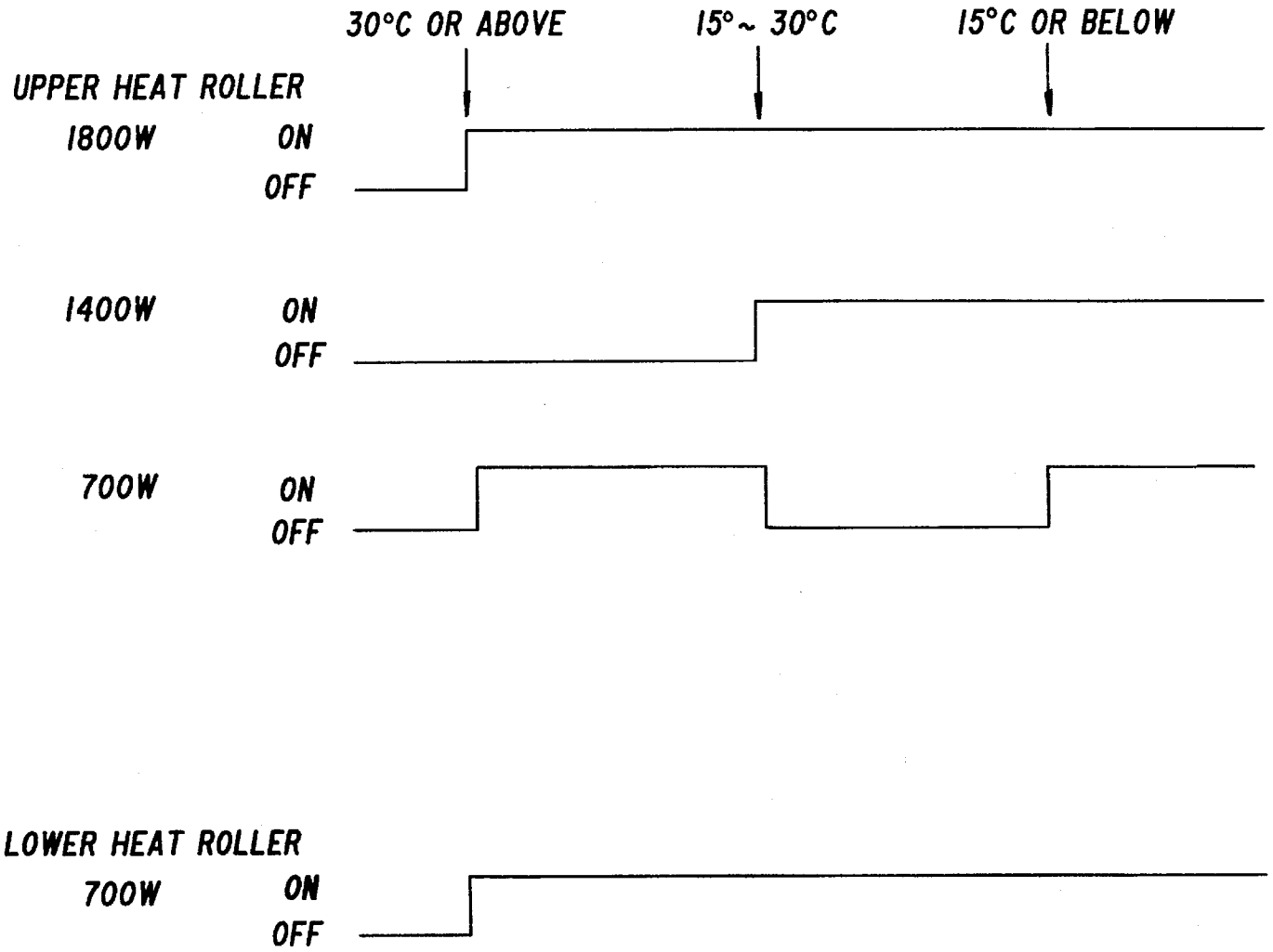
FIG. 15 is an explanatory diagram for a fixing operation according to the fourth embodiment.

FIG. 14 is a flowchart illustrating various operations relating to the heat roller according to the fourth embodiment of the present invention. FIG. 15 is an explanatory diagram for a fixing operation according to the fourth embodiment.

For the sake of simplicity, the capacity of the halogen lamp 51*a*, of the heat roller 50 is 700 W; the capacity of the halogen lamp 51*b* is 1400 W; and the capacity of the halogen lamp 51*c* is 1800 W in the following description. Also, FIG. 14 illustrates a modification of the process steps S8 to S10 in full-colored printing mode in FIG. 7.

The fixing control for the heat roller 50 is hereinafter discussed in reference to FIG. 14.

(S1) When the host computer 8 instructs full-colored printing, the controller 71 checks the detected temperature of the ambient temperature sensor 76.

(S2) When the detected ambient temperature is 30° C. or above, the controller 71 checks the detected temperature of the temperature sensor 59*a* of the heat roller 50.

(S3) When the detected temperature is not at a specified temperature (e.g, 170° C.), the controller 71 sets the set/reset switch circuits 72, 74 to apply a voltage to the halogen lamp 51*a*, of 700 W and to the halogen lamp 51*c* of 1800 W. As a result, the halogen lamps 51*a*, 51*c* heat up and generate heat amounting to 2500 W. The halogen lamp 55 of the pressure roller 54 generates heat of 700 W at this time, as described earlier, so that the total amount of heat becomes 3200 W which can melt four toner layers at the ambient temperature of 30° C. or above, as described earlier in reference to FIG. 13. The operation of the controller 71 then returns to step S2.

(S4) When the detected temperature is equal to or above the specified temperature, on the other hand, the controller 71 resets the set/reset switch circuits 72, 74 in order to stop applying a voltage to the 700 W halogen lamp 51*a*, and the 1800 W halogen lamp 51*c*. As a result, the halogen lamps 51*a*, 51*c* are turned off. The controller 71 then returns to step S2.

(S5) When determining, in step S1, that the ambient temperature of the fixing unit is between 15° C. and 30° C., the controller 71 checks the detected temperature of the temperature sensor 59*a* of the heat roller 50.

(S6) When the detected temperature is not at a specified temperature (e.g., 170 C.), the controller 71 sets the set/reset switch circuits 73,74 in order to apply a voltage to the halogen lamp 51*b* of 1400 W and the halogen lamp 51*c* of 1800 W. As a result, the halogen lamps 51*b*, 51*c* heat up and generate heat amounting to 3200 W. Since the halogen lamp 55 of the pressure roller 54 generates heat of 700 W at this time, as described earlier, the total amount of heat becomes 3900 W which can melt four toner layers at the ambient temperature of 15° C. to 30° C., as described earlier in reference to FIG. 13. The controller 71 then returns to step S5.

(S7) When the detected temperature is equal to or above the specified temperature, on the other hand, the controller 71 resets the set/reset switch circuits 73, 74 in order to stop applying a voltage to the halogen lamps 51*b*, 51*c* . As a result, the halogen lamps 51*b*, 51*c* are turned off. The controller 71 then returns to step S5.

(S8) When determining, in step S1, that the ambient temperature of the fixing unit is 15° C. or below, the controller 71 checks the detected temperature of the temperature sensor 59*a* of the heat roller 50.

(S9) When the detected temperature is not at a specified temperature (e.g., 170° C. ), the controller 71 sets the set/reset switch circuits 73, 72, 74 in order to apply voltages to the three halogen lamps 51*a*, 51*b*, 51*c* of 700 W, 1400 W and 1800 W. As a result, the halogen lamps 51*a*, 51*b*, 51*c* heat up and generate heat amounting to 3800 W. As described earlier, the halogen lamp 55 of the pressure roller 54 generates heat of 700 W at this time so that the total amount of heat becomes 4600 W which can melt four toner layers at the ambient temperature of 15° C. or below, as described earlier in reference to FIG. 13. The controller 71 then returns to step S8.

(S10) When the detected temperature is equal to or above the specified temperature, on the other hand, the controller 71 resets the set/reset switch circuits 73, 72, 74 in order to stop applying a voltage to the three halogen lamps 51*a*, 51*b*, 51*c* of 700 W, 1400 W and 1800 W. As a result, the halogen lamps 51*a*, to 51*c* are turned off. The controller 71 then returns to step S8.

This operation is illustrated as a time charge in FIG. 15. When a printing instruction is received, the pressure roller (lower heat roller) 54 generates heat of 700 W. When the ambient temperature is 30° C. or above, the heat roller (upper heat roller) 50 generates heat of 2500 W. On the other hand, when the ambient temperature is at a range of 15° C. to 30° C. the heat roller (upper heat roller) 50 generates heat of 3200 W. When the ambient temperature is 15° C. or below, the heat roller (upper heat roller) 50 generates heat of 3900 W.

The consumed power can be reduced in the above manner in accordance with the ambient temperature even in full-colored printing that requires a large amount of power.

(f) Description of Other Embodiments

The present invention may be modified in various other manners as follows.

(1) The second and third embodiments, as modifications of the first embodiment, may be adopted as modifications of the fourth embodiment. For instance, a structural arrangement selectively using three halogen lamps of 1600 W provided in the heat roller 50 or a structural arrangement of using a single halogen lamp with the generated heat thereof changing in accordance with the input voltage may be employed as the modifications of the fourth embodiment.

(2) Although the image forming apparatus has been explained as an electophotographing mechanism, this invention many be employed as a printing mechanism for transferring a toner image (e.g., as an electrostatic recording mechanism).

(3) Sheets are not limited to paper, but can include other media as well.

(4) Although the image forming apparatus has been described as a printer, it may be a different type of image forming apparatus, such as a copying machine or facsimile.

(5) Although the transfer section has been described as a transfer roller, a transfer charger may be used as well.

(6) Although the heat generator has been described as a halogen lamp, another heat element may also be used.

As described above, the present invention has the following advantages.

(1) The amount of power supply to the second heating device 54 is made constant, and the amount of power supply to the first heating device 50 is changed depending on whether the toner image is monochromatic or multicolored. Since the image fixation is accomplished by the energy of the first heating device 50, the efficiency of image fixation with respect to the applied energy is high. The consumed power can therefore be considerably reduced.

(2) Since the amount of power consumption of the second heating device 54 does not change, it is possible to prevent the fixed toner image from melting even in the printing on both sides of the recording medium; thereby, preventing disturbance of the image.

While the invention has been particularly shown and described in reference to preferred embodiments thereof, it will be understood by those skilled in the art that changes in form and details may be made therein without departing from the spirit and scope of the invention.

What is claim is:

1. A color image forming apparatus, comprising:

toner image forming means for forming a monochromatic toner image or a toner image in a plurality of colors on a recording medium;

first heating means, located on a toner image side of said recording medium, for fixing said toner image on said recording medium by heat;

second heating means located on an opposite side of a toner image side of said recording medium; and a controller means for making a power supply to said second heating means constant, and for changing a power supply to said first heating means depending on whether said toner image is monochromatic or in a plurality of colors while making a set temperature of said first heating means constant, wherein said toner image forming means forms said toner image on one surface of said recording medium, and wherein an inverting path is provided to turn over said recording medium with said one surface thereof having undergone image fixation and returns said recording medium to an entrance of said toner image forming means in order to form a toner image on a back surface of said recording medium with said one surface thereof having undergone image fixation.

2. The color image forming apparatus according to claim 1, wherein said first heating means is a heat roller which includes a halogen lamp, and said second heating means is a backup roller which includes a halogen lamp.

3. The color image forming apparatus according to claim 2, wherein said heat roller is provided with a plurality of independently controllable halogen lamps.

4. The color image forming apparatus according to claim 3, wherein said halogen lamps have different electric capacities.

5. The color image forming apparatus according to claim 3, wherein said halogen lamps have the same electric capacity.

6. The color image forming apparatus according to claim 2, wherein said heat roller is provided with a single halogen lamp, and wherein said controller means changes an input voltage to said halogen lamp.

7. The color image forming apparatus according to claim 1 or 2, further comprising a temperature sensor means for detecting an ambient temperature of said apparatus, and wherein said controller means controls said amount of power supply to said first heating means in accordance with a temperature detected by said temperature sensor means.

8. The color image forming apparatus according to claim 1, wherein said toner image forming means have a plurality of photosensitive drums for forming a toner image each having different colors.

9. A fixing apparatus for fixing a monochromatic toner image or a toner image in a plurality of colors on a recording medium formed by toner image forming means, wherein said toner image forming means forms said toner image on one surface of said recording mediums, and wherein an inverting path is provided to turn over said recording medium with said one surface thereof having undergone image fixation and returns said recording medium to an entrance of said toner image forming means in order to form a toner image on a back surface of said recording medium with said one surface thereof having undergone image fixation, said fixing apparatus comprising:

first heating means, located on a toner image side of said recording medium, for fixing said toner image on said recording medium by heat;

second heating means located on an opposite side of a toner image side of said recording medium; and a controller means for making a power supply to said second heating means constant, and for changing a power supply to said first heating means depending on whether said toner image is monochromatic or in a plurality of colors while making a set temperature of said first heating means constant.

* * * * *